US005730665A

United States Patent [19]

Shimosaka et al.

[11] Patent Number: 5,730,665

[45] Date of Patent: Mar. 24, 1998

[54] GOLF BALL AND METHOD OF MAKING SAME

[75] Inventors: Hirotaka Shimosaka; Keisuke Ihara; Yutaka Masutani; Michio Inoue; Atuki Kasasima, all of Chichibu, Japan

[73] Assignee: Bridgestone Sports Co., Ltd, Tokyo, Japan

[21] Appl. No.: 772,999

[22] Filed: Dec. 23, 1996

[30] Foreign Application Priority Data

Dec. 22, 1995 [JP] Japan ..... 7-350271

[51] Int. Cl.[6] ..... A63B 37/12; A63B 37/14

[52] U.S. Cl. ..... 473/376; 473/378; 473/383; 264/260; 264/264; 264/265

[58] Field of Search ..... 473/361, 363, 473/364, 365, 378, 374, 383, 376; 264/260, 264, 265; 273/DIG. 4, DIG. 5, DIG. 8, DIG. 2

[56] References Cited

U.S. PATENT DOCUMENTS 5,019,320 5/1991 Hasegawa ..... 473/272
5,273,286 12/1993 Sun ..... 473/376 X

*Primary Examiner*—George J. Marlo
*Attorney, Agent, or Firm*—Sughrue, Mion, Zinn, Macpeak & Seas, PLLC

[57] ABSTRACT

A golf ball has a core (1) enclosed with a cover (2) wherein the cover (2) is embossed on its surface with dimples by compression molding in a mold and includes an innermost layer (3), an intermediate layer (4), and an outermost layer (5). The intermediate layer (4) and the outermost layer (5) are formed of a laminate film while the outermost layer (5) is made of a material which is smoothly releasable from the mold. The golf ball is readily removed from the mold at the end of molding and has a high precision of dimple geometry.

7 Claims, 1 Drawing Sheet

GOLF BALL AND METHOD OF MAKING SAME

BACKGROUND OF THE INVENTION

1. Field of the Invention

This invention relates to a golf ball comprising a core and a multi-layer cover having at least three layers. The invention also relates to a method for preparing the same golf ball. More particularly, it relates to a golf ball which is smoothly releasable from a mold and embossed with dimples at high precision during its preparation and a method for preparing the same.

2. Prior Art

Ionomer resin base materials are often used as the cover stock for wound golf balls as well as solid golf balls. The cover stock is molded around the core by injection molding and compression molding techniques. Particularly when a cover is molded by compression molding, the cover stock tends to stick to the mold. Obstructed mold release causes difficult ejection of the golf ball from the mold, resulting in a loss of productivity. More specifically, due to obstructed mold release, the ball surface is subject to flaws and stripping, which requires post-treatment, and the mold must be cared for at short intervals.

Moreover, with respect to conventional golf balls, it is a common practice to apply a coating on the cover surface of a golf ball as molded for protecting the cover. Such a coating, however, is difficult to apply to a uniform thickness. Since a coating is applied after dimple formation, dimples on the final product golf ball have a diameter and depth deviating from the design basis diameter and depth, leading to a loss of dimple precision and failing to provide the design basis dimple aerodynamics. Flight performance and spin rate thus deviate deviated from the expectation. Especially due to a variation in coating thickness, the desired flight performance is not accomplished.

SUMMARY OF THE INVENTION

Therefore, an object of the present invention is to provide a golf ball featuring smooth mold release, high productivity, and precise dimple geometry. Another object of the present invention is to provide a method which ensures efficient preparation of such golf balls.

The present invention is directed to the preparation of a golf ball by enclosing a core with a multi-layer cover including an innermost layer, an intermediate layer, and an outermost layer while embossing the cover with dimples by compression molding in a mold. According to the invention, a core having the cover innermost layer formed thereon is wrapped with a laminate film including a resin layer to form the cover intermediate layer and another resin layer to form the cover outermost layer, and the wrapped core is placed in a negative dimple pattern-bearing mold and thermocompression molded therein for thereby constructing the cover including the innermost, intermediate and outermost layers around the core while embossing dimples in the cover surface. Desirably, the other resin layer of the laminate film to form the cover outermost layer is made of a material having mold release characteristics such as an ethylene-vinyl acetate copolymer, polyurethane, and polyethylene in consideration of mold release after thermocompression molding, and the cover innermost layer and intermediate layer are constructed of an ionomer resin base material which is a suitable cover stock. This process prevents the dimple geometry precision from being degraded due to ineffective mold release after molding and ensures efficient manufacture of golf balls having a cover of better performance.

More particularly, since the golf ball of the invention is characterized in that the intermediate and outermost layers of the cover are formed by thermocompression molding and that in embossing dimples in the cover surface, the outer layer of the laminate film in contact with the negative dimple pattern-bearing cavity surface of the mold is constructed of a material having release characteristics, a ball as molded can be removed from the mold without reducing dimple precision. That is, dimples can be configured at high precision. The invention eliminates a loss of dimple precision which often occurs in the prior art when coating treatment is done after dimple formation to form a finish layer as the outermost layer. Since the innermost and intermediate layers of the cover need not take mold release into account, an appropriate cover stock such as ionomer resin can be used therefor so that the cover itself may have better performance. Since the innermost layer need not take dimple formation and mold release into account, a resin material to form the innermost layer can be molded by any desired molding technique suitable for that material such as injection molding such that the innermost layer may be close to the core. Moreover, since the inner layer of the laminate film to come in contact with the innermost layer is made of a material of the same type as the innermost layer, the intermediate and outermost layers can be tightly joined to the innermost layer.

Accordingly, in a first aspect, the present invention provides a golf ball comprising a core and a cover, the cover being embossed on its surface with dimples by compression molding in a mold and including an innermost layer, at least one intermediate layer, and an outermost layer, wherein the intermediate layer and the outermost layer are formed of a laminate film while the outermost layer is made of a material which is smoothly releasable from the mold.

In a second aspect, the present invention provides a method for preparing a golf ball comprising a core and a multi-layer cover including an innermost layer, at least one intermediate layer, and an outermost layer, comprising the steps of injection molding a resin layer around the core to form the innermost layer of the cover; wrapping the innermost layer with a laminate film including at least one resin layer to form the at least one cover intermediate layer and another resin layer having mold release characteristics to form the cover outermost layer; and placing the wrapped core in a negative dimple pattern-bearing mold and thermocompression molding the wrapping laminate film therein for thereby forming the intermediate layer and the outermost layer on the innermost layer to complete the cover and embossing dimples in the cover surface.

BRIEF DESCRIPTION OF THE DRAWINGS

These and further features of the present invention will be apparent with reference to the following description and drawings, wherein.

DETAILED DESCRIPTION OF THE INVENTION

Figure 1:
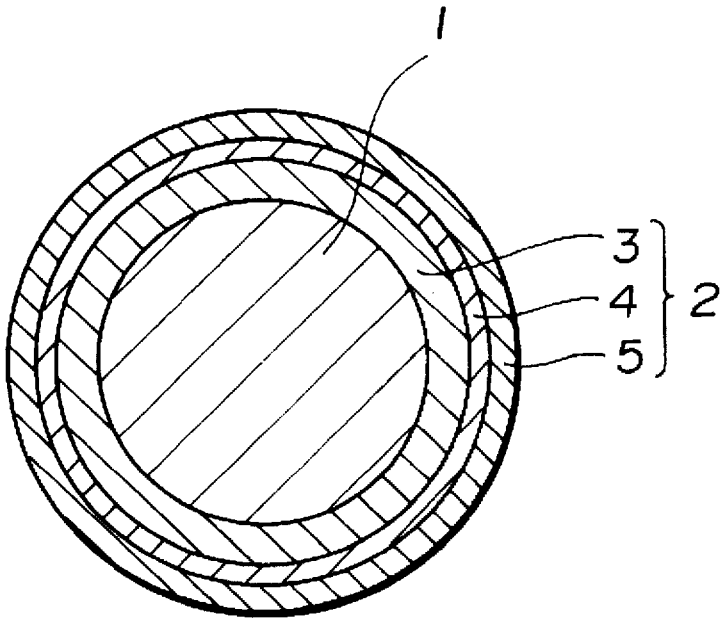
FIG. 1 is a schematic cross-sectional view of a golf ball according to one embodiment of the invention.

Referring to FIG. 1, a golf ball according to the invention is illustrated as comprising a core 1 which is enclosed with a cover 2 consisting of an innermost layer 3, an intermediate layer 4 (which may consist of one or more laminae), and an outermost layer 5, which are arranged in concentric fashion.

Dimples (not shown) are embossed in the surface of the cover 2 by compression molding. The intermediate and outermost layers 4 and 5 are constructed of a laminate film. The layer of the laminate film to form the outermost layer 5 is made of a material which is smoothly releasable from a mold.

The golf ball of the invention may be either a wound golf ball wherein the core 1 is a wound core or a solid golf ball wherein the core 1 is a solid core although the invention favors a solid golf ball. The solid core and wound core used herein are not critical and may be similar to those used in conventional golf balls. Cores prepared from well-known materials by well-known techniques may be used. The diameter of the core is not critical and may have an ordinary value. Typically the core has a diameter of 33 to 40.5 mm, especially 37 to 40 mm.

The innermost layer 3 constructing the cover 2 around the core 1 may be formed of any well-known material having appropriate characteristics as a cover stock for golf balls, for example, ionomer resins, polyester elastomers, and polyamide elastomers alone or in admixture with urethane resins and ethylene-vinyl acetate copolymers. In the practice of the invention, an ionomer resin or a resin mixture based on an ionomer resin is preferably used. Additives such as titanium dioxide, barium sulfate, magnesium stearate and well-known antioxidants may be added to the ionomer resin or ionomer resin based resin mixture.

Any desired procedure may be used to form the innermost layer 3 on the core 1 depending on the type of resin used and the type of the core. For example, where the innermost layer is formed around a solid core using an ionomer resin, injection molding is preferred because closer contact is accomplished between the innermost layer 3 and the core 1. Where the innermost layer is formed around a wound core using an ionomer resin, the preferred procedure involves preforming a pair of half cups from the ionomer resin, enclosing the core with them, and thermocompression molding.

The innermost layer 3 constructs the majority of the cover 2 and usually has a gage (or radial thickness) of 1 to 2 mm, especially 1.5 to 2.0 mm. An innermost layer of less than 1 mm thick would fail to provide the cover with acceptable performance. It should be understood that when the innermost layer 3 is formed, no dimples need be formed on its surface and it is only required that a resin layer of a desired gage be formed around the core in tight junction.

The intermediate layer 4 which is formed on the innermost layer 3 and constructs a laminate film with the outermost layer 5, to be described later is made of a material well bondable with the innermost layer 3. More particularly, the intermediate layer 4 is made of a material identical with or of the same type as the material of the innermost layer 3 alone or a resin mixture based on such material. Preferably an ionomer resin is used alone or in admixture with titanium dioxide, antioxidant, UV absorber, etc.

It is noted that the intermediate layer 4 may be a single layer or consist of a plurality of laminae including an adhesive lamina of an epoxy or polyurethane composition and a lamina of another resin such as polyester, polyurethane, polyamide, silicone, and polypropylene as well as the ionomer resin lamina, with the additional lamina or laminae being disposed between the ionomer resin lamina and the outermost layer. The gage of the intermediate layer 4 is not critical although it usually ranges from 50 to 400 μm, especially 75 to 300 μm.

The outermost layer 5 constructing a laminate film with the intermediate layer 4 is made of a material having improved mold release characteristics so that it may not stick to the mold when dimples are embossed in the cover surface by thermocompression molding. For example, ethylene-vinyl acetate copolymers, polyurethane, and polyethylene are used. The gage of the outermost layer 5 is not critical although it usually ranges from 5 to 100 μm, expecially 5 to 50 μm, more especially 20 to 50 μm. Particularly when the outermost layer 5 substitutes for the conventional finish coating layer, it is preferably as thin as 20 to 50 μm. The resin of which the outermost layer 5 is made may be other than the above-mentioned resins insofar as it has improved release characteristics. By selecting the material of the outermost layer 5 to provide a suitable hardness, the spin rate of the golf ball upon hitting can be more or less adjusted. For the outermost layer 5, a softer material offers a higher spin rate while a harder material offers a lower spin rate.

Onto the innermost layer 3 the intermediate and outermost layers 4 and 5 are provided as a laminate film having layers which are to form the intermediate and outermost layers 4 and 5. The laminate film can be manufactured in a conventional manner by means of a conventional laminator.

The intermediate and outermost layers 4 and 5 are formed by wrapping the core 1 having the innermost layer 3 formed thereon with the laminate film, placing the wrapped core in a mold, and effecting thermocompression molding for bonding the intermediate layer 4 to the innermost layer 3. This process completes the cover 2 consisting of the innermost layer 3, intermediate layer 4, and outermost layer 5 and at the same time, embosses dimples in the cover 2 during the thermocompression molding step, resulting in a golf ball according to the invention. In one preferred embodiment, the core 1 having the innermost layer 3 formed thereon is wrapped with a laminate film, the laminate film is brought in tight contact with the innermost layer 3 by means of a well-known vacuum packaging equipment, the tightly wrapped core is then placed in a mold where thermocompression molding is carried out. This ensures that the intermediate layer 4 is tightly bonded to the innermost layer 3.

In this way, the core 1 is enclosed with the cover 2 consisting of the innermost layer 3, intermediate layer 4, and outermost layer 5 while configuring dimples in the cover 2 at the same time. The subsequent procedure includes a conventional deburring and optional coating treatment to form a finish coating layer before a golf ball is completed. According to the present invention, the subsequent coating treatment can be omitted since the outermost layer of the cover may serve as the finish layer.

Since the intermediate and outermost layers of the cover are formed from a laminate film including layers which are to form the intermediate and outermost layers and the outermost layer is made of a material having release characteristics, a molded ball can be smoothly removed from the mold after the laminate film is joined to the innermost layer and dimples are embossed in the cover surface by compression molding. The invention eliminates the inconvenience of the cover material sticking to the mold to degrade the dimple geometry precision. Since the outermost layer of the cover may serve as a finish layer, the invention eliminates a need for finish treatment to form a coating layer on the cover surface after molding, which would degrade the dimple geometry precision.

Therefore, the golf ball of the invention ensures the precision of dimple geometry and prevents the cover material from sticking to the mold. This results in easy maintenance of the mold and increased productivity.

EXAMPLE

Examples of the present invention are given below by way of illustration and not by way of limitation. All parts are by weight.

Example 1

A solid core having a diameter of 39.2 mm was prepared by a conventional procedure using the rubber composition shown below.

| Rubber composition | Parts by weight |
|---|---|
| Cis-1,4-polybutadiene rubber | 100 |
| Zinc acrylate | 24 |
| Zinc oxide | 10 |
| Barium sulfate | 14 |
| Anti-oxidant | 1 |
| Dicumyl peroxide | 1 |

The core was placed in a smooth cavity of a mold where an ionomer resin (Himilan 1605 by Mitsui Dupont Polychemical K.K.) was injection molded around the core to form a cover or innermost layer of 1.6 mm thick. The resulting ball had a smooth spherical surface free of dimples.

The ball consisting of the core and the innermost layer was then wrapped with a film laminate consisting of two layers, an ionomer resin film of 100 μm thick (Himilan 1855) and an ethylene-vinyl acetate (EVA) copolymer film of 50 μm thick such that the ionomer resin layer was inside and the EVA layer was outside. The film laminate was brought in tight contact with the innermost layer by means of a vacuum packaging equipment. The tightly wrapped ball was then placed in a negative dimple pattern-bearing cavity of a mold where the ball was heated and compressed at 160° C. and 120 kg/cm$^2$ for 5 minutes to bond the laminate to the innermost layer and emboss dimples in the surface. The ball as molded was taken out of the mold and polished for deburring, completing a solid golf ball having a three-layer structure cover.

Although the mold cavity had not been treated in any way, the molded ball could be readily removed from the mold. Smooth mold release was ensured. The dimples on the ball were inspected and no defects were found including deformation and flaws. The ball had the design basis dimple geometry precision. The mold cavity was also inspected to find no deposits of the cover material. The mold was ready for subsequent use without treatment.

Comparative Example 1

A solid core having a diameter of 39.2 mm was prepared from the same rubber composition as in Example 1 and an ionomer resin (Himilan 1605) was injection molded around the core to form a smooth cover of 1.75 mm thick. The ball was placed in a negative dimple pattern-bearing cavity of a mold where the ball was heated and compressed at 160° C. and 120 kg/cm$^2$ for 5 minutes to emboss dimples in the cover surface. The ball as molded was taken out of the mold, polished for deburring, and coated on the surface with a thermosetting urethane paint to form a finish coating layer, completing a solid golf ball.

When the molded ball was removed from the mold whose cavity had been treated in no way, the removal was difficult because the ball firmly stuck to the mold. The dimples on the ball were inspected to find that some dimples had defects including deformation, small bosses and flaws. The dimple geometry precision was low. The mold cavity was also inspected to find deposits of the cover material. The mold should be cleaned and coated with a release agent before use in subsequent molding cycles.

Although some preferred embodiments have been described, many modifications and variations may be made thereto in the light of the above teachings. It is therefore to be understood that within the scope of the appended claims, the invention may be practiced otherwise than as specifically described.

We claim:

1. A golf ball comprising a core and a cover having an outer surface, the cover being embossed on its outer surface with dimples by compression molding in a mold and including an innermost layer, at least one intermediate layer, and an outermost layer, wherein said intermediate layer and said outermost layer are formed of a laminate film while said outermost layer is made of a material which is smoothly releasable from the mold.

2. The golf ball of claim 1 wherein said outermost layer of said cover is made of a material predominantly comprising a component selected from the group consisting of an ethylene-vinyl acetate copolymer, polyurethane, and polyethylene.

3. The golf ball of claim 1 wherein said innermost layer of said cover is an ionomer resin base layer formed around the core by injection molding, and the inner surface of said intermediate layer in contact with said innermost layer is provided by an ionomer resin base layer included in the laminate film.

4. The golf ball of claim 1 wherein in said cover, said innermost layer has a gage of 1 to 2 mm, said intermediate layer has a gage of 50 to 400 μm, and said outermost layer has a gage of 5 to 100 μm.

5. A method for preparing a golf ball comprising a core and a multi-layer cover including an innermost layer, at least one intermediate layer, and an outermost layer, said method comprising the steps of:

injection molding a resin layer around the core to form the innermost layer of said cover, wrapping the innermost layer with a laminate film including at least one resin layer to form the at least one cover intermediate layer and another resin layer having mold release characteristics to form the cover outermost layer, and placing the wrapped core in a negative dimple pattern-bearing mold and thermocompression molding the wrapping laminate film therein for thereby forming the intermediate layer and the outermost layer on the innermost layer to complete the cover and embossing dimples in the cover surface.

6. The method of claim 5 wherein the other resin layer having mold release characteristics to form the cover outermost layer is made of a material predominantly comprising a component selected from the group consisting of an ethylene-vinyl acetate copolymer, polyurethane, and polyethylene.

7. The method of claim 5 wherein both the resin layer injection molded around the core to form the cover innermost layer and the resin layer of the laminate film to form the cover intermediate layer are ionomer resin base layers.

* * * * *